US005375976A

United States Patent [19]

Arnaudeau

[11] Patent Number: 5,375,976

[45] Date of Patent: Dec. 27, 1994

[54] PUMPING OR MULTIPHASE COMPRESSION DEVICE AND ITS USE

[75] Inventor: Marcel Arnaudeau, Paris, France

[73] Assignee: Institut Francais du Petrole, Rueil Malmaison, France

[21] Appl. No.: 86,887

[22] Filed: Jul. 7, 1993

Related U.S. Application Data

[63] Continuation of Ser. No. 943,986, Sep. 11, 1992, abandoned.

[30] Foreign Application Priority Data

Jul. 27, 1990 [FR] France ..... 90 09607

[51] Int. Cl.[5] ..... F04D 7/00; F04D 3/00

[52] U.S. Cl. ..... 415/199.5; 416/DIG. 2

[58] Field of Search ..... 415/192, 194, 195, 198.1, 415/199.4, 199.5; 416/DIG. 2

[56] References Cited

U.S. PATENT DOCUMENTS

| | | | |
|---|---|---|---|
| 2,331,076 | 10/1943 | Medlahl | 415/195 |
| 2,985,952 | 5/1961 | Nutter et al. | 416/DIG. 2 |
| 4,504,189 | 3/1985 | Lings | 415/192 |

FOREIGN PATENT DOCUMENTS

| | | | |
|---|---|---|---|
| 2157437 | 6/1973 | France . | |
| 2333139 | 6/1977 | France . | |
| 2471501 | 6/1981 | France . | |
| 1263914 | 10/1986 | U.S.S.R. | 415/194 |

*Primary Examiner*—Edward K. Look

*Assistant Examiner*—Michael S. Lee

*Attorney, Agent, or Firm*—Antonelli, Terry, Stout & Kraus

[57] ABSTRACT

The present invention relates to a device to compress a multiphase fluid such as petroleum effluent comprising a liquid phase and a gaseous phase and a method to use the device. The device comprises a housing (1), an impeller having an inlet section and an outlet section. The impeller comprises an axisymmetric hub (28) with an axis Ox and a number n of blades rotating around the axis. The blades have a leading edge (C1, C2) and a trailing edge (C'1, C'2). The fluid enters the impeller va the inlet section (41) and leaves via the outlet section (42). The axis is orientated in the direction of advance of the fluid. The number of rotating blades (29, 30) is equal to or greater than 2. At least one channel or passage is defined by two successive blades (29, 30) whose orthoradial section S(x) is of the form, within 5% and preferably within less than 3%:

$$S(x)=ax^2+b(c-x^2)^{\frac{1}{2}}+d$$

on at least one portion of its length. The one portion is between two orthoradial lanes with the variable x corresponding to the absciss along the axis between points $x_1$ and $x_2$ and having an origin corresponding approximately to the radial plane passing through the leading edge of the blades with the planes defining the portion and a, b, c and d being parameters.

27 Claims, 6 Drawing Sheets

PUMPING OR MULTIPHASE COMPRESSION DEVICE AND ITS USE

This is a continuation of application Ser. No. 943,986 filed Sep. 11, 1992 now abandoned.

BACKGROUND OF THE INVENTION

The present invention relates to a device for pumping multiphase fluids which, prior to pumping and in considered temperature and pressure conditions, are formed from the mixture of a liquid and gas not dissolved in the liquid. The liquid may possibly be saturated with the gas.

DESCRIPTION OF THE PRIOR ART

The pumping of a multiphase fluid, such as, but not exclusively, a diphase petroleum effluent composed of an oil and gas mixture, poses a certain number of problems, these problems being that much more difficult to resolve when thermodynamically a condition of the diphase fluid prior to pumping is a high gas liquid ratio.

The gas liquid ratio, designated subsequently via the abbreviation GLR, is defined as the ratio of the volume of fluid in a gaseous condition to the volume of fluid in the liquid state. The value of this ratio depends on the thermodynamic conditions of the diphase fluid.

Irrespective of the pumps used (alternative pumps, rotary pumps or tromp effect pumps) good results are obtained when the value of the gas liquid ratio is small, as the fluid then behaves like a liquid monophase fluid. These items of equipment are still usable when their operating conditions do not allow for the vaporization of a significant part of the gas dissolved in the liquid or when the value of the gas liquid ratio at the pump inlet is at the most equal to 0.2. Experience shows that beyond this value, the effectiveness of these devices decreases very quickly and are virtually no longer usable.

So in order to improve the operation of existing devices, the gaseous phase is separated from the liquid phase prior to pumping and each of the phases is processed separately in separate pumping circuits. The use of separate circuits is not always possible and in any event complicates the pumping operations.

This is the reason why attempts have been made to develop pumping devices which increase the total energy of the diphase fluid and also produce a diphase fluid whose gas liquid ratio at the outlet of the device has a value of less than that of the fluid prior to pumping.

Accordingly, several impeller turbine blade profiles have been described, for example, in the French patents 2,157,437, 2,333,139 and 2,471,501.

SUMMARY OF THE INVENTION

The implementation of the invention may be designated under the name compression cell and may also be called a compression pumping cell since it is entirely suitable for liquids, liquid gas mixtures and gases.

The present invention relates to a device which uses blade, blading or paddles which are able to increase the efficiency of pumping diphase fluids whose gas liquid ratios are greater than those of the prior art. In particular, the device of the present invention makes it possible to process multiphase fluids regardless of the GLR with a compression efficiency possibly exceeding 40% or 50% in the most favorable operating range.

A compression cell of the invention generally includes two sections: an impeller and a diffuser. Of these two elements, the impeller is the basic element. The impeller is usually mounted on a rotating shaft and is keyed or hooped onto this shaft. The diffuser is static and integral with the body of the machine. The series mounting of several of the compression cells constitutes the hydraulic cell of a pump.

According to the conventional rules relating to the construction of rotating machines, the shaft is supported at two or more points by bearings integral with mechanical journal bearing units included in the pump body. The pump comprises suction and discharge elements.

The compression cells may be identical or have different dimensions.

The compression cells are essentially defined by their geometries.

The object of the present invention is to provide a device to compress a multiphase fluid comprising a liquid phase and a gaseous phase. The device comprises a housing and impeller having an inlet section and an outlet section. The impeller comprises an axisymmetric hub which has an axis symmetric with an axis Ox and a number n of blades rotating around the axis. The blades have one leading edge and one trailing edge. The fluid enters the impeller via the inlet section and leaves the impeller via the outlet section. The axis is orientated in the direction of advance of the fluid with the number of rotating blades being equal to or greater than 2. The invention has at least one channel or passage defined by two successive blades whose orthoradial section S(x) is of the form, within 5% and preferably within less than 3%:

$$S(x)=ax^2+b(c-x^2)^{\frac{1}{2}}+d$$

on at least one portion of its length, the portion being between two orthoradial planes, the variable x corresponding to the absciss along the axis between points $x_1$ and $x_2$ and having an origin approximately corresponds to the radial plane passing through the leading edge of the blades with the planes defining the portion and a, b, c and d being parameters.

The value a may be equal to:

$$a=\frac{l}{n}\times\pi$$

n being equal to the number of blades of the impeller.

The values of b and c may be equal to:

$$b=\frac{l}{n}\,2\pi M+\frac{e}{\sin Bc}\text{ and }c=(M-R_1)^2$$

$$M=\frac{1^2+R_3^2-R_1^2}{2(R_3-R_1)}$$

e=blade thickness $B_c$=cord angle l=axial length of blades $R_1$=minimum radius of blades at inlet $R_2$=maximum radius of blades at inlet $R_3$=maximum radius of blades at outlet The value d may be expressed by the following equation:

$$d = \frac{l}{n}\left[(R_2 - M)\pi(R_2 + M) + \frac{e}{\sin B_c} - (M - R_1)^2\right]$$

The blades may have upper edges inscribed in a revolution cylinder having an axis of symmetry Ox.

The portion of the channel may correspond to the entire length of the channel.

For the intrados angles, the inlet angles of the blades are between 4° and 24° and preferably between 4° and 12°, and for the extras angles between 2° and 23° and preferably between 2° and 11°.

The recess of the blades defined as:

$$B_{sm} - B_{em}$$

may be between 0° and 30° and preferably between 6° and 12° with $B_{sm}$ being the mean outlet angle of the blade and $B_{em}$ being the mean inlet angle of the blade.

The mean thickness of the blade is between 3 and 5 mm outside the neighboring zones of the leading and trailing edges.

The number of blades may be between 3 and 8 and preferably between 4 and 6 with area limiters included.

The blades may have an intrados outlet angle of between 4° and 54° and preferably between 10° and 24° and for the extrados angle between 2° to 58° and preferably between 8° to 23°.

The mean profile or skeleton of the blades defined by the intersection of a blade with minimal thickness and a cylindrical surface respectively parallel to the axis may be such that the angle the mean profile forms with the axis decreases monotonically from the leading edge to the trailing edge and the curve representing the value of the curvature along the profile of the blade as a function of the curved absciss to a slope whose value increases from the leading edge toward the trailing edge of the blade.

The curve may have one reversal point.

The device of the invention may comprise a blade diffuser. The diffuser may comprise between 8 and 30 blades and preferably between 15 and 25 blades.

The ratio of the axial length of the impeller with respect to its outer diameter may be between 0.10 and 0.40 and preferably between 0.15 and 0.20.

The hub of the diffuser may have a form of revolution around the axis Ox and the line considered in an axial plane generating this form of revolution may have at least one reversal point. This line may have tangents parallel to the axis at the two extremities of this line corresponding to the inlet and outlet of the diffuser.

The present invention also relates to the use of at least one device as described above in a multiphase pump and the use of such a multiphase pump for carrying out multiphase petroleum effluent pumping operations.

BRIEF DESCRIPTION OF THE DRAWINGS

All the advantages of the invention, the invention being of a simple design, robust and profitable to use, shall be apparent from a reading of the following description illustrated by the accompanying figures.

DESCRIPTION OF THE PREFERRED EMBODIMENTS

The word "fluid" shall mean a gaseous monophase fluid, a liquid fluid in which a gas is totally dissolved or a multiphase fluid comprising one liquid phase and one gaseous phase, as well as possibly any solid particles, such as sand, or viscous particles, such as hydrate agglomerates. The liquid phase may clearly be made up of different types of liquids and similarly the gaseous phase may be formed of several different types of gases.

Figure 1:
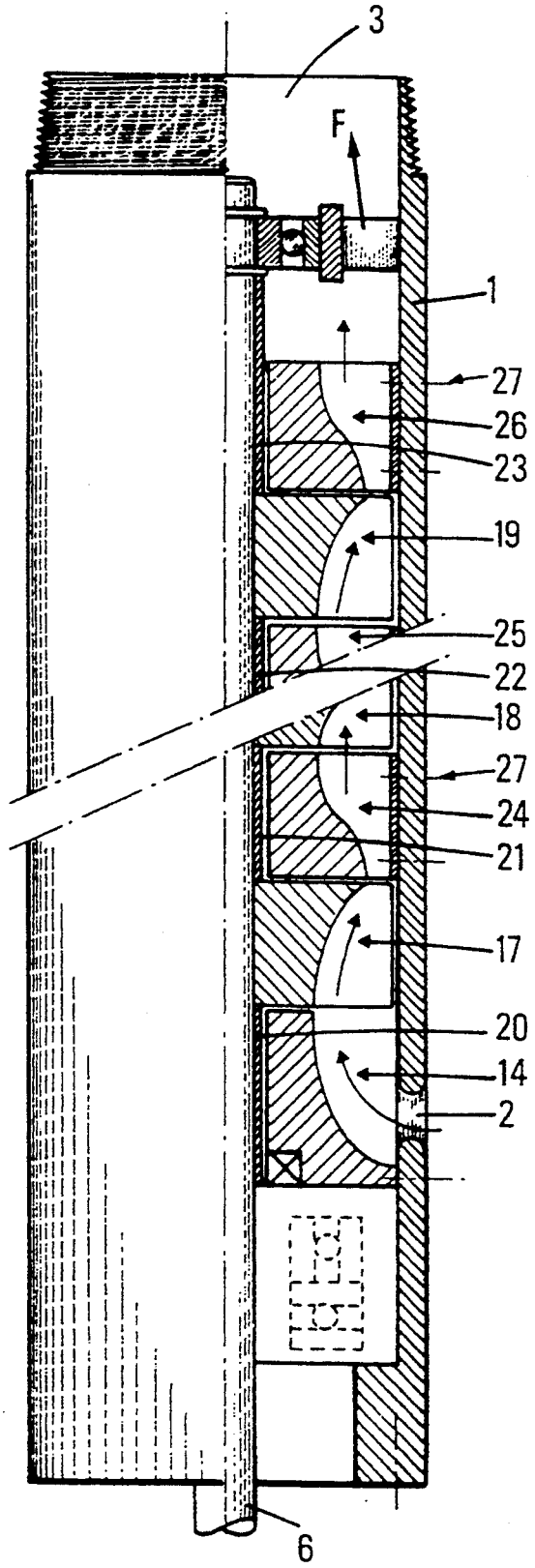
FIG. 1 is a diagrammatic axial section of a pumping device embodying the invention and suitable for pumping a diphasic effluent (from an oil well)

FIG. 1 diagrammatically shows in axial section of a particular non-limitative embodiment of the invention in the form of a pumping unit. This unit is designed to pump a petroleum multiphase effluent.

In the example of FIG. 1, at least one compression cell according to the invention is placed between the intake 2 and discharge 3 ports of the pumping device and inside the housing. This cell increases the total energy of the fluid. FIG. 1 shows three impellers referenced 17 to 19. This number is not limitative and depends on the pressure increase desired to be obtained.

These elements, to be described subsequently in more detail, are integral with the shaft 6 on which they are tightly fitted. For example, the spacing between the elements is maintained by braces 20 to 23.

Preferably, a diffuser such as the diffusers 24 to 26, are placed at the outlet of each impeller. The diffuser is integral with the housing 1 by means of for example fixing screws 27 (symbolized by the dot-and-dash lines on the figure).

Each impeller and diffuser coupling (17, 24, 19, 26) with a housing portion comprises a compression cell.

The reference 14 designates a deflector.

In order to illustrate the invention with clarity in FIG. 1, the clearances between the braces and the diffusers, between the impellers and the housing and between the impellers and the diffusers have significantly been increased. However, it must be understood that these clearances are reduced to their minimum value compatible with the mechanical operation of the pump so that any fluid leaks become minimal and so that at operating temperature the expansion of the various components of the pumping device do not cause contact and jamming.

Figure 2:
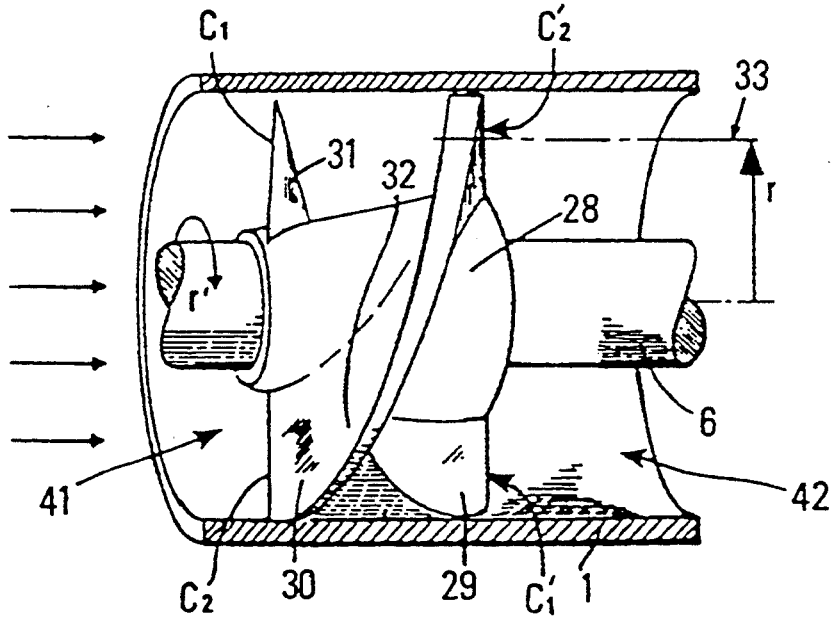
FIG. 2 shows a perspective view of an impeller in accordance with the invention.

FIG. 2 diagrammatically shows in perspective a non-limitative embodiment of an impeller stage comprising a hub 28 integral with the shaft 6 which, during operation of the device, is rotated in the direction shown by the arrow r'. Two blades 29 and 30 have been shown on FIG. 2, but this number is not limitative. Generally speaking, a number of blades is selected facilitating the static and dynamic balancing of the rotor. The height of the blades is such that their shape when rotating is complementary to the bore of the housing 1 which, in the example shown, is cylindrical.

These blades may be inserted into the hub 28 and secured hereto by welding but it is preferable to manufacture the unit, namely the hub and blades, by molding or milling.

The impeller and the distributor are of the helical type.

Figure 3:
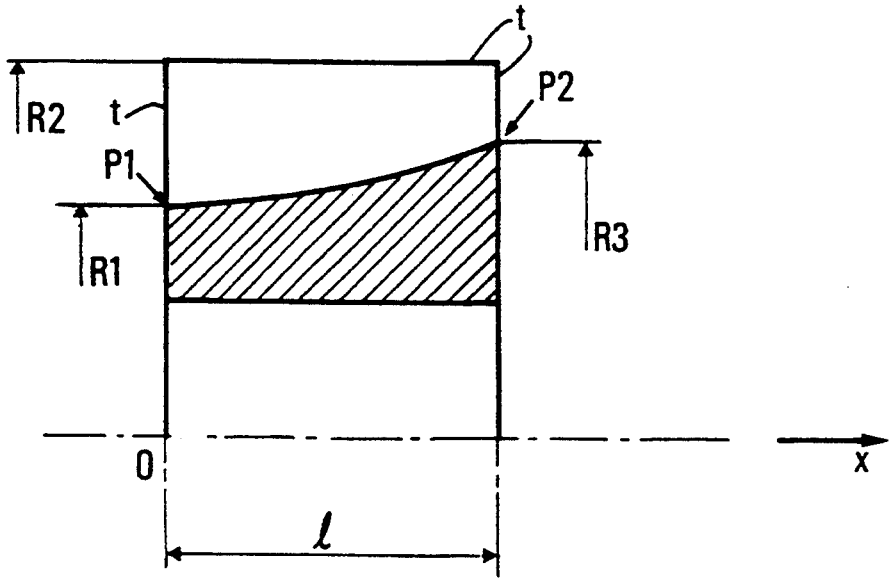
FIG. 3 represents a section of an impeller in accordance with the invention containing a blade.

FIG. 3 defines the dimension of the impeller according to the invention. FIG. 3 is diagrammatic, with only the hub being shown as a section and the track t of a blade has been represented. $R_2$ is the outer radius of the impeller and thus of the cell.

The quantity 2 $R_2$ is the outer diameter of the impeller that is the nominal diameter frequently used.

$R_1$ is the radius of the hub, inlet face side, on the left in FIG. 3.

$R_3$ is the radius of the hub, outlet face side, shown on the right in FIG. 1.

l is the length along the axis of the impeller, namely the distance between the inlet face and the outlet face.

$P_1P_2$ represents the curve corresponding to the intersection of the hub with an axial plane passing through the axis of rotation Ox.

Ox is the axis of rotation with O being the point on the axis of intersection having the previously defined inlet face.

$P_1$ is the tangent to the curve $P_1P_2$, is perpendicular to the inlet face and is parallel to the axis Ox.

The hatched part of FIG. 3 corresponds to the axisymmetric hub.

Figure 4:
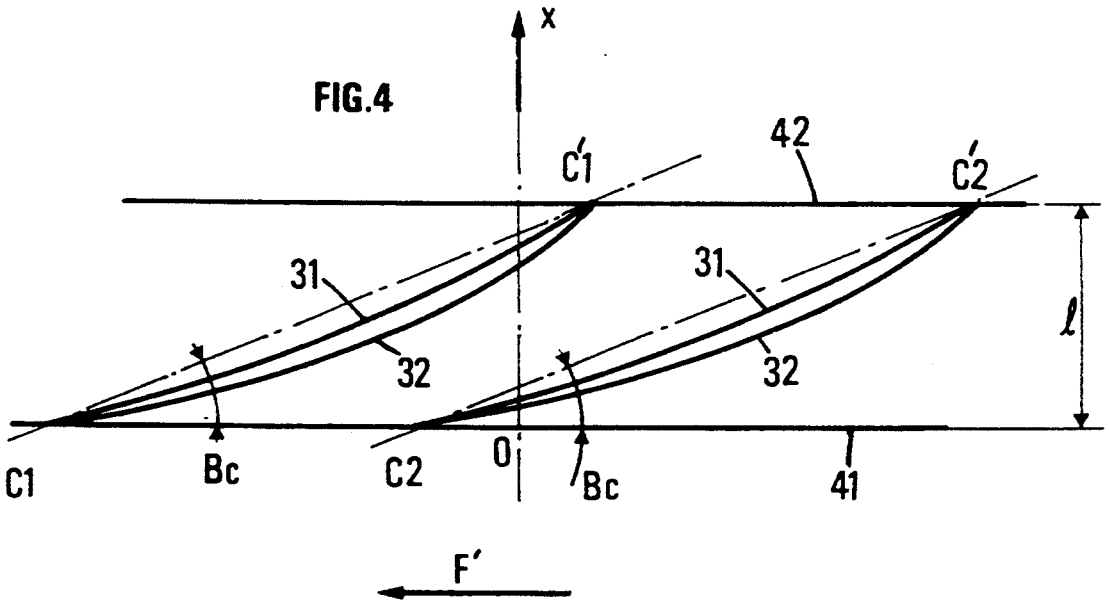
FIG. 4 is a view of the track resulting form the intersection of blades with a cylindrical surface.

FIG. 4 defines the blades of the impeller.

The blades are mounted on the previously described hub. The number of blades n is always equal to or more than 2. The number may be between 4 and 6, especially for impellers whose blade's outer diameter varies between 100 and 400 mm.

The simplest representation to describe the blade is to define its profile on the surface of the cylindrical housing to the outer radius r with r variable between $R_3$ and $R_2$. This surface is represented in the plane of FIG. 4.

FIG. 4 shows the track C1C2 of the inlet face represented by a straight line 41 and the track $C'_1$ $C'_2$ of the outlet face represented by a straight line 42.

The two straight lines 41 and 42 are parallel and the distant l referred to above in FIG. 3 is the length of the impeller.

FIG. 4 also shows the track of the axis Ox orientated in the direction extending from the inlet face to the outlet face. The arrow F' designates the direction of advance of the blades.

The blades are integral with the hub. These are geometrically defined as follows. Each blade comprises two faces, one intrados face 31 and one extrados face 32, a leading edge at the point $C_1$ (or at the point $C_2$), a trailing edge at the point $C'_1$ (or at the point $C'_2$) and a thickness defined as the distance between the intrados and the extrados faces.

Figure 5:
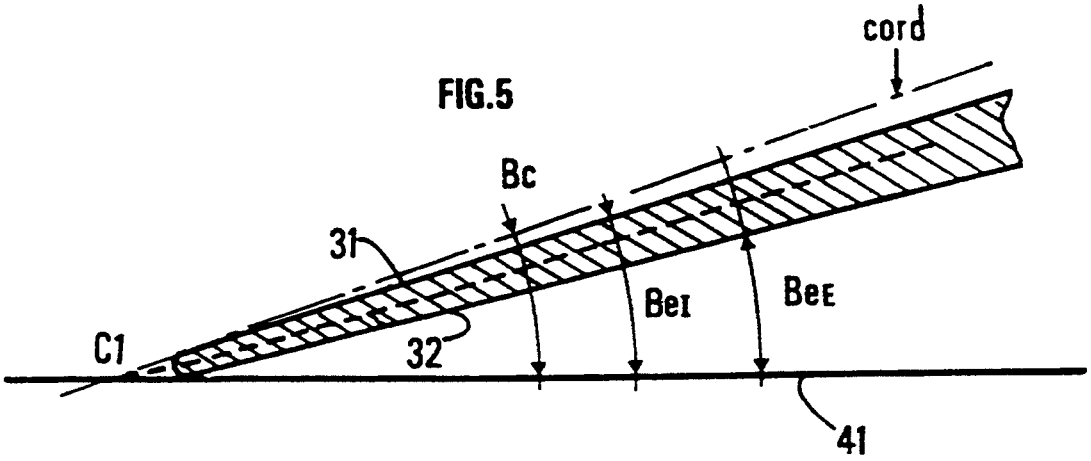
FIGS. 5 and 6 respectively show the details of the leading edge and trailing edge of a blade.
Figure 6:
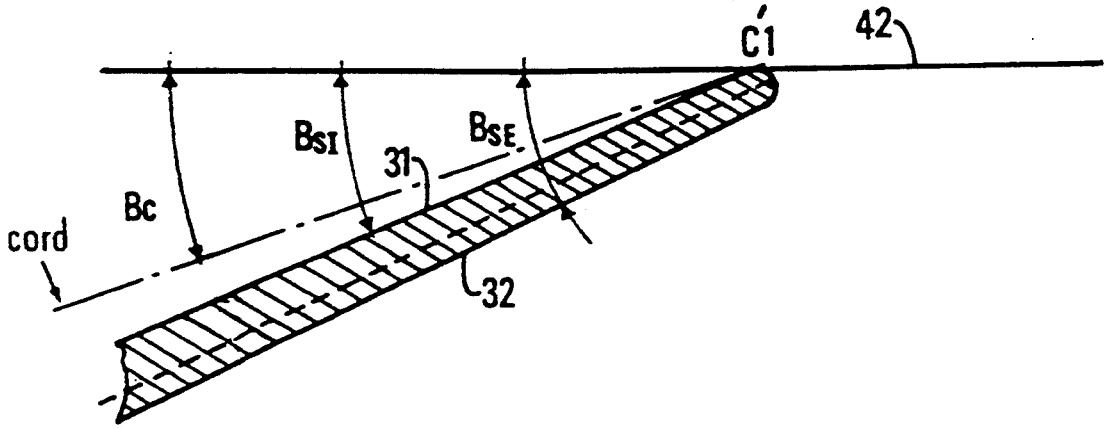

The angles of the blades are defined in FIGS. 5 and 6. The intrados inlet angle $B_{eI}$ is the angle of the tangent at $C_1$ (or $C_2$) at the intrados face with the track 41 of the inlet face. The extrados face inlet angle $B_{eE}$ is the angle of the tangent at $C_1$ (or $C_2$) at the extrados face with the track of the inlet face. The intrados face outlet angle $B_{sI}$ and the extrados outlet angle $B_{sE}$ are defined in the same way with respect to the points $C'_1$ and $C'_2$ and the track 42 of the outlet face. The cord angle $B_c$ is defined, as for any profile, namely the angle of the cord $C_1C'_1$ or $C_2C'_2$, straight lines joining first the points $C_1$ and $C'_1$ (or $C_2$ and $C'_2$) and then of the track or outlet face. The various angles are defined from a direction parallel to the straight line 41 or 42.

FIG. 6 shows the cord merged with the profile of the intrados face close to the trailing edge.

The length of the cord $C_1C'_1$ is then equal to the value $l/\sin B_c$, l and $B_c$ defined as above.

Let n be the number of blades. The length relation $C_1C_2=2\pi R_2/n$ defines the orthoradial distance that is within a plane perpendicular to the axis Ox between two blades.

The shape of the actual blade is defined by the tracks of the intrados and extrados faces in the plane of FIG. 4.

The curve of the intrados face linking $C_1$ to $C'_1$ may be defined by a second degree equation as a function of the curvilinear absciss of the blade extending from $C_1$. This curve is tangential to the track of the angle $B_{eI}$ at the point $C_1$ and to the track of the angle $B_{sI}$ at the point $C'_1$.

The curve of the extrados face linking $C_1$ to $C'_1$ may be defined by an equation of the fourth degree as a function of the curvilinear absciss of the blade extending from $C_1$. This curve has a tangent forming an angle $B_{eE}$ close to $C_1$ and $B_{SE}$ close to $C'_1$.

The skeleton or mean fiber of the blade may be represented by an equation of the fourth degree.

The bending radii Pm of the blades are also defined as a function of the curvilinear absciss. Thus, the curves 1/pm and in particular the mean fiber curve are defined.

Finally, the variation of the curve is defined as a function of the curvilinear absciss of the mean fiber called d(1/pm)ds. The curve d(1/pm)/ds is an increasing curve and continually increases with a reversal point. It is possible to use the shape of the skeleton described in the French Patent 2,333,139.

The thickness of the blades is small (virtually between three and five millimeters, for certain particular industrial applications, the thickness of the blades may be larger) in the case where the thickness of the blade is not constant or may not be regarded as such in formulae which follow either the real thickness of the blade as a function of the absciss or use a fixed value for the thickness of the blade. This thickness may be the average thickness of the blade. The blades are generally finer on the leading edges and trailing edges. In current technology regarding leading and trailing edges, shapes are used having a track in the plane of FIG. 4 which are semicircles with a radius of about 1 mm (minimum 0.5 mm, maximum 2.5 mm).

The recess of the blades is defined as the difference of the mean outlet $B_{sm}$ and inlet $B_{em}$ angles (or of the mean fiber), more precisely $B_{SE}$ and $B_{SI}$ being defined at the outlet, we have $B_{sm}\simeq(B_{SE}+B_{Si})/2$ a the 1st order precision being several percent; similarly, we have:

$$B_{em}\simeq[B_{eI}+B_{eE}]/2$$

The recess defined as the difference $B_{sm}-B_{em}$ is one of the characteristics of these impellers.

The angle of the recess is preferably between 6° and 12° but its values may cover a range of from 0° to 30° in certain cases.

The inlet angles are also preferably selected between limited values. $B_{eI}$ is between 4° and 24° and preferably between 4° and 12°.

$B_{eE}$ is between 2° and 23° and preferably between 2° and 11°.

The orthoradial distance between the blades is defined as being the distance between one point of an intrados face and one point of the extrados face of the preceding blade measured in an orthoradial plane perpendicular to the axis Ox (namely perpendicular to the plane of FIG. 4). This distance is always measured on cylindrical surfaces with the axis Ox and always is a function of the radius r of the cylinder 33 illustrated in FIG. 2 with r being smaller than the nominal radius R2 but may range up to values very close to $R_2$.

In the strict geometric and also in the technological and physical sense, this orthoradial distance is equal for any orthoradial plane with an absciss x (counted on Ox) to the value at any point Pc:

$$2\pi r/n - e/\sin(B_{Pc})$$

with terms defined as follows:

r is the radius of reference cylinder.

n is the number of blades of the impeller as previously defined.

e is the blade thickness.

$B_{Pc}$ is the angle of the skeleton or mean fiber for a current point.

This distance is also geometrically equal for practical industrial embodiments to the orthoradial distance between two blades positioned in such a way that the mean fibers would be merged with the cord of the blade which thus also gives a distance equal to the quantity $2\pi r/n - e/\sin B_c$.

The helicoaxial pump is defined as all the pumps or all the compressors by virtue of its volumetric flow rate and nominal flow rate.

The inlet and outlet sections of the impeller may be determined from triangles of speeds by applying, apart from other laws, the laws of Euler in relation with the desired nominal operating conditions.

The orthoradial section defines the hydraulic channel.

As regards the impeller of this invention, the evolution of the section of the hydraulic channel or this orthoradial section of the channel is defined, having regard possibly to the radial thickness of the blades. This sectional evolution takes into account the following geometrical parameters $R_2$, $R_1$, $R_3$, l, n, $B_c$, and e. The blade thickness, as mentioned earlier is assumed to be minimal, constant or nonconstant. In the case where the thickness is assumed as to be minimal or constant when this is actually not the case, it will be necessary to admit practical differences with respect to the formulations proposed above.

The section is defined with respect to x *(current point)* on Ox and may also be defined as a function of the curvilinear abscissa of the cord of the blade profile.

The parameters used in the formulation are defined as follows:

$$M=[l^2+(R_3^2-R_1^2)]/2(R3-R_1)$$

$$A=(M-R_1)^2=[l_2+(R_3-R_1)^2]^2/[2(R_3-R_1)^2$$

$$B=R_2^2-M^2-A$$

The section of the hydraulic channel $S_1$ for a theoretical blade of minimal thickness is written:

$$S_1(x)=(\pi/n)[x^2+2M(A-x^2)^{\frac{1}{2}}+B]$$

The orthoradial section of a blade S2 is written:

$$S_2(x)=[R_2-M+(A-x^2)^{\frac{1}{2}}](e/\sin Bc)$$

The real orthoradial section of a hydraulic channel S is written:

$$s(x)=S1(x)-S_2(x)$$

Thus $$S(x)=(1/n)[nx^2+(A-x^2)^{\frac{1}{2}}(2\pi M=e/\sin cB_c)+(R2-M)(\pi(R_2+M)+e/\sin B_c)-(M-R_1)^2]$$

In the case where all the channels are not identical, it is possible to consider n, not as the number of blades, but as a parameter linked to the relative inlet section of each of the channels.

The formulation as a function of the curvilinear abscissa of a current point on the cord of the profile is simply written by replacing x by $s/\sin B_c$ where s is the curvilinear abscissa.

According to the present invention, the orthoradial section of at least one passage evolves in the way indicated by the formula giving S(x). Nevertheless, the differences with respect to this formula may be less than 5% or preferably less than 3% between two abscissa orthoradial planes $x_1$, $x_2$ as illustrated in FIG. 2. Of course, it is preferable that the section of a channel given by the above-mentioned formula is obtained as closely as possible with regard in particular to manufacturing tolerances.

The distance $x_1$, $x_2$ along the axis Ox, for which the formula providing the variation of the orthoradial section is verified in the precise conditions already previously indicated, is equal to at least 80% of the length of the impeller and preferably more than 90%.

Due to the tapering ratio of the blades at the leading edge and at the trailing edge, it is possible to admit, when it is desired that the formulae giving the variation of the orthoradial section is thoroughly checked and on the largest possible length of the hub, that the blades are not all of the same pitch over a certain length of the blades at two extremities. These lengths corresponding to the tapering ratios of the blades may be determined as a function of the different of the thickness counted as a percentage of the maximum thickness (generally situated in the middle of the length of the evolute blade or at the mean thickness of the blade). Listed below are lengths with respect to the curvilinear absciss of the skeleton measured from the curvilinear abscissa $l_r$ with the following variations.

a) $l_r=3\%$ from the leading edge where the length required ensures that the thickness of the blade reaches more than 50% of the mean thickness, b) $l_r=3\%$ in front of the trailing edge where the length from which the thickness of the blade is less than 50% of the mean thickness.

According to the present invention, the ratio between the length of the impeller at its outer diameter may be between 10 and 40% and preferably between 15 and 25%.

At the outlet of an impeller stage, the fluid is driven at a speed having at least one axial component and one circumferential component. As well recognized by specialists, the use of a diffuser makes it possible to increase the static pressure by eliminating or at least reducing the circumferential component from the fluid flow speed. This diffuser may be of any known type with characteristics adapted to those of the impeller stage as indicated on FIGS. 8 and 9.

Figure 8:
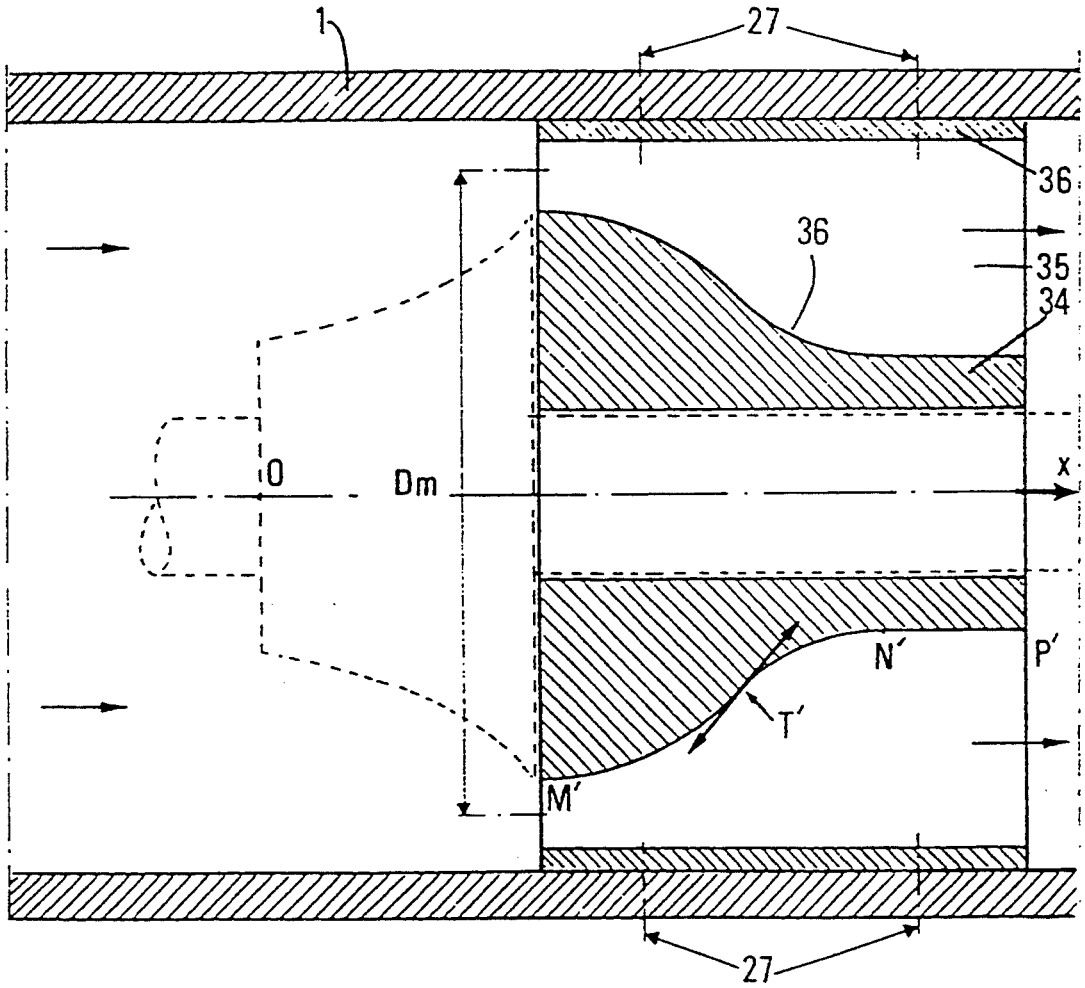

FIG. 8 shows a sectional view of an assembly including an impeller (represented by the broken lines) and a diffuser (represented by the continuous line).

Figure 9:
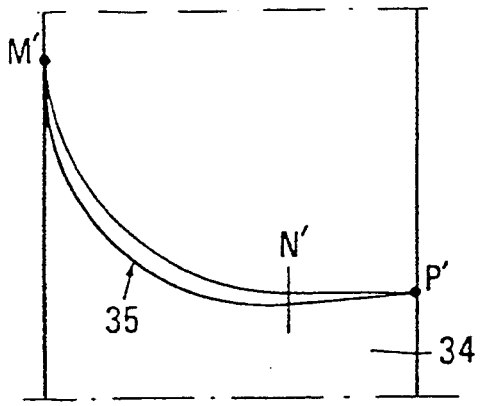
FIGS. 8 and 9 represent a diffuser.

FIG. 9 diagrammatically represents the developed track of the intersection of one blade of the distributor with a cylindrical surface with radius r.

The diffuser is made up of a sleeve 34 which carries at least two paddles 35. A ring 36 secured to the paddles 35 makes it possible to render integral the diffuser and the housing 1 with the aid of screws 27.

The outer diameter of the sleeve 34 progressively decreases from the inlet towards the outlet on a first portion M'N' possibly representing at least 30% of the total length of the diffuser measured parallel to the axis and which is equal to at least 30% of the mean diameter Dm of the blades at the distributor inlet. Thus, the fluid passage section increases according to a first or second degree law when the direction of flow indicated by the arrows is considered.

The paddles 35 have a suitably-adapted profile allowing the straightening of the fluid flow. At the inlet of the diffuser this profile is approximately tangential to the flow whereas at the end of the first portion M'N', the profile of the paddles is approximately tangential to a plane passing through the axis of the device with the angle of inclination progressively varying on this first portion.

In order to simplify the production of the diffuser the first portion M'N' of the paddles is given a constant bending radius.

The remaining portion N'P' of the paddle is disposed axially and the hub on this portion is cylindrical.

The right inlet section $S_e$ (FIG. 7) of a diffuser is selected as being larger than the outlet section $S_s$ (FIG. 7) of the stage impeller preceding the diffuser so that the ratio $S_e/S_s$ may have a value of between 1 and 1.2 and preferably between 1.1 and 1.15. The ratio $S_s/S_e$ between the right sections between the outlet and inlet of the distributor is higher than 1 and preferably between 2 and 3.

The foregoing shows a slight axial clearance between the trailing edge of the blades of the impeller and the leading edge of the blades of the diffuser, but it is possible to space them from one another by a distance to be established by the technician during setting up tests according to the conditions of use of the device.

Figure 10:
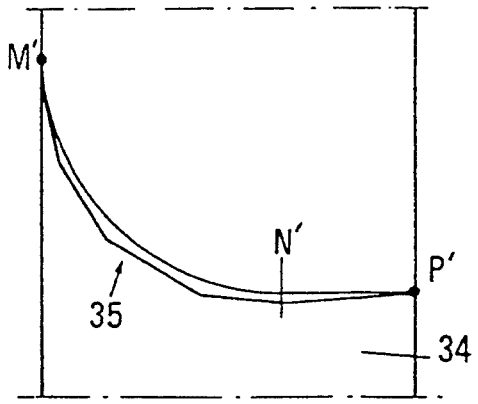
FIG. 10 shows another embodiment of a blade or paddle of the diffuser.

Modifications may be made without departing from the context of the present invention. For example and as shown by FIG. 10, the extrados face of each paddle of the straightener may be obtained by machining portions of intersecting planes.

Advantageously, the sleeve may have a form of revolution obtained by the rotation of a plain line 36 M', T', N', P' around the axis Ox of the compression cell. Line 36 comprises at least two sections. A first section M'T' corresponds to an arc of a circle whose center is on the same side as the axis Ox. A second section T' N' also corresponds to an arc of a circle with preferably the same radius as the first arc M'T', but whose center is situated on the other side of the line in relation to the center of the circle of the first arc M'T'.

The two arcs of a circle M'T' and T'N' are interconnected at T' with preferably parallel tangents at this point where in this case T' is a reversal point of the curve M'T'N'. The orthogonal projection on the axis Ox of the arc M'T' may be equal to the corresponding length of either the arc T'N' or of the curve T'P'.

The tangents to the line M'T'N'P at M' and P' may be parallel to the axis Ox and possibly comprise a third rectilinear section N'P' parallel to the axis Ox. The previously described line M'T'N'P' has been described in an axial plane of the compression cell.

The length of the impeller and straightener may be equal.

Figure 7:
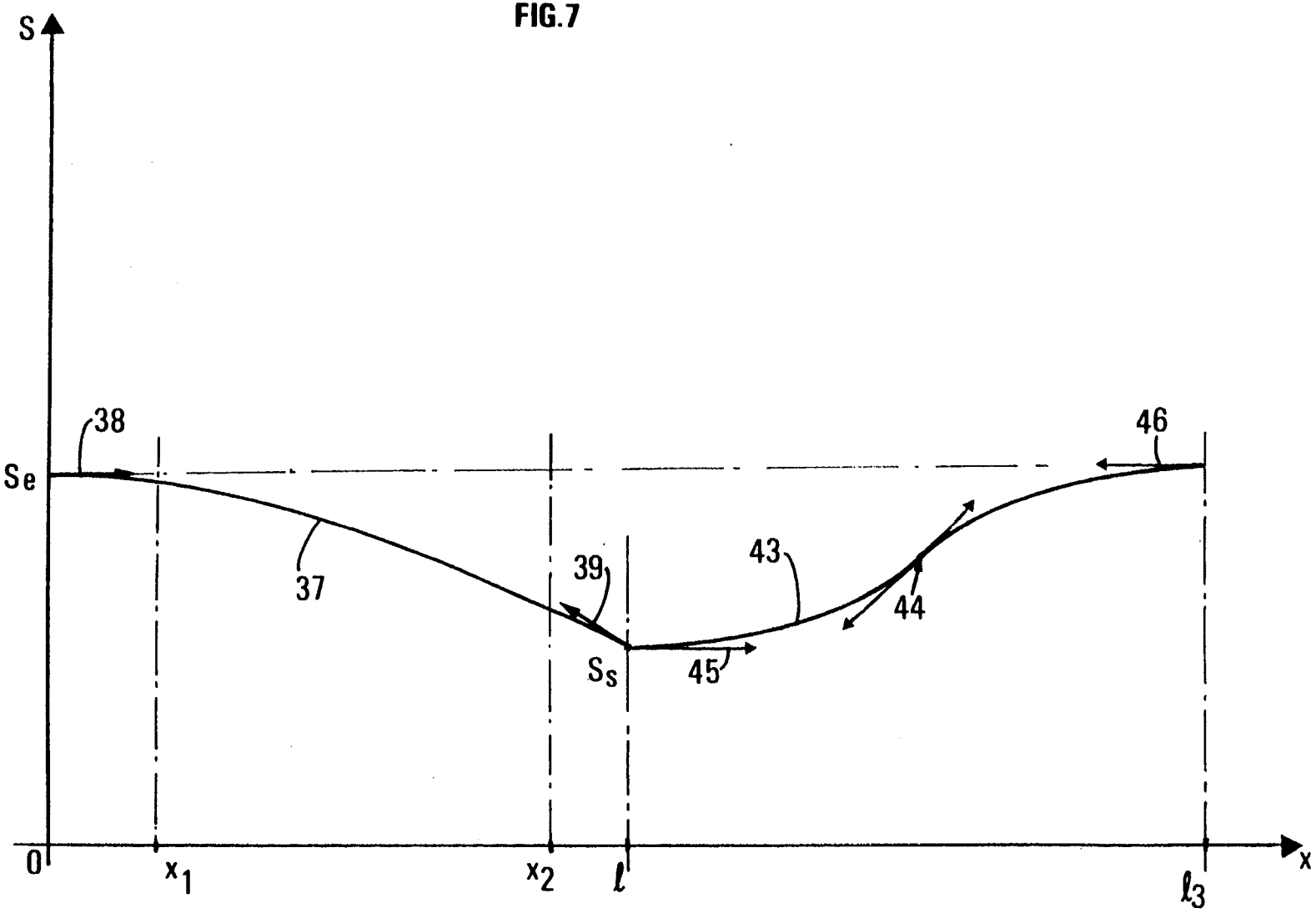
FIG. 7 shows the evolution of the section of a passage as a function of the axial abscissa.

FIG. 7 shows two curves corresponding to the variation of the orthoradial section of a channel of the impeller as a function of the absciss on the axis Ox. The origin of this axis corresponds to the inlet face of the impeller. The inlet face comprises the section of the leading edge most downstream in relation to the flow of gases.

This section of this curve 37 extends as far as the abscissa l corresponding to the length of the impeller between which the abscissae $x_1$ and $x_2$ are disposed with the formulation given previously for the variation of the orthoradial section S being observed in accordance with the precise conditions previously described.

$x_1$ may be equal to $l-x_2$.

The length $x_1$ may correspond to the length where the thickness of the blade reaches 80 or 90% of the mean thickness. Generally speaking, this length may correspond to 3% of the length of the curvilinear abscissa.

Similarly, $x_2$ may be determined as being the start of the zone $x_2$ l where the thickness of the blade deviates by more than 10 or 20% from the mean thickness.

The tangent 38 to the curve 37 at $S_e$ may be horizontal.

FIG. 7 shows that the tangent 39 to the curve at the absciss point l has a negative slope.

The curve 43 corresponds to the evolution of the orthoradial section of one channel of the diffuser multiplied by $n_r/n_i$ the where $n_r$ corresponds to the number of blades or paddles of the diffuser and $n_i$ the number of blades or paddles of the impeller.

The curve 43 is a continuous curve between the abscissae l and $l_3$ an does not have any singular point. This curve has a reversal point 44.

Preferably, the absciss of this reversal point may approximately be equal to $(l+l_3)/2$.

The tangent 45 to the inlet of the diffuser, corresponding to the absciss l with clearance between the impeller and diffuser, is almost horizontal (parallel to the axis Ox). The same applies at the outlet of the diffuser where the tangent 46 is parallel to the axis Ox.

The length $l_3-l$ corresponds to the axial length of the diffuser.

The outlet section $S_s$ of the channel of the impeller is preferably strictly equal to the inlet section of the diffuser.

What is claimed is:

1. A device for compressing a multiphase fluid having a liquid phase and a gaseous phase comprising:

a housing; and an impeller having a inlet section and an outlet section, a hub and a number n of blades equal to or greater than 2 with the blades rotating around an axis, the blades having a leading edge and a trailing edge with the fluid entering into the impeller via the inlet section and leaving the impeller via the outlet section with the axis being oriented in a direction of advance of the fluid, and at least one channel defined by two successive blades having an orthoradial section equal to or less than 5% of a quantity S(x) where $$S(x)=ax^2+b(c-x^2)^{\frac{1}{2}}+d$$

along at least a portion of a length of the channel with the portion being between two orthoradial planes and the variable x corresponding to the absciss along the axis between points $x_1$ and $x_2$ and having an origin corresponding approximately to a radial plane passing through the leading edge of the blades with the planes defining the portion and a, b, c and d being parameters.

2. A device according to claim 1, wherein:

$$a=\pi/n.$$

3. A device according to claim 1, wherein:

b equals (l/n) $[2\pi M+e/\sin B_c]$;
c equals $(M-R_1)^2$; where
M equals $(l^2+R_3^2-R_1^2)/[2(R_3-R_1)]$;
e is a blade thickness;
$B_c$ is a cord angle;
l is an axial length of the blades;
$R_1$ is a minimum radius of the blades at the inlet section;
$R_2$ is a maximum radius of the blades at the inlet section; and
$R_3$ is minimum radius of blades at the outlet.

4. A device according to claim 3, wherein:

$$d=(l/n)[(R_2-M)(\pi(R_2+M)+e/\sin B_c)-(M-R_1)^2].$$

5. A device according to claim 1, wherein:
the blades have one upper edge being inscribed in a revolution cylinder having an axis Ox as an axis of symmetry.

6. A device according to claim 1, wherein:
the portion corresponds to an entire length of the channel.

7. A device according to claim 1, wherein:
the portion corresponds to a length between 80 to 90% of a length of the impeller.

8. A device according to claim 1, wherein:
inlet angles of the blades for an intrados face are between 4° and 24° and for an extrados face between 2° and 23°.

9. A device according to claim 8, wherein:
the inlet angles of the blades for the intrados face are between 4° and 12° and for the extrados face between 2° and 11°.

10. A device according to claim 1, wherein:
a recess of the blades is between 0° and 30°.

11. A device according to claim 10, wherein:
the recess of the blades is between 6° and 12°.

12. A device according to claim 1, wherein:
a mean thickness of the blades is between 3 and 5 mm outside neighboring zones of the leading and trailing edges.

13. A device according to claim 1, wherein:
n is between 3 and 8 including blades of area limiters.

14. A device according to claim 13, wherein:
n is between 4 and 6.

15. A device according to claim 1, wherein:
the blades have an intrados face outlet angle of between 4° and 54° and an extrados face angle between 2° and 58°.

16. A device according to clam 15, wherein:
the intrados face outlet angle is between 10° and 24° and the extrados face angle is between 8° and 23°.

17. A device according to claim 1, wherein:
a mean profile of the blades defined by an intersection of a blade of minimal thickness and having a cylindrical surface in relation to the axis is such that an angle of a mean profile formed with the axis decreases monotonically from the leading edge towards the trailing edge and a curve along the profile of a blade is a function of absciss curves at a slope having a value increasing from the leading edge towards the trailing edge of the blade.

18. A device according to claim 17, wherein:
the curve has one reversal point.

19. A device according to claim 1, further comprising:
a diffuser.

20. A device according to claim 19, wherein:
the diffuser comprises blades.

21. A device according to claim 20, wherein:
the diffuser comprises between 8 and 30 blades.

22. A device according to claim 21, wherein:
the diffuser comprises between 15 and 25 blades.

23. A device according to claim 19, wherein:
a hub of the diffuser has a form of revolution around an axis Ox and wherein a line in an axial plane generating the form of revolution has at least one reversal point.

24. A device according to claim 23, wherein:
the line has tangents parallel to the axis at two extremities of the line.

25. A device according to claim 1, wherein:
a ratio of axial length of the impeller in relation to an outer diameter of the impeller is between 0.10 and 0.40.

26. A device according to claim 25, wherein:
the ratio is between 0.15 and 0.20.

27. A device in accordance with claim 1, comprising a multiphase pump.

* * * * *